US005222466A

United States Patent [19]

Gratziani

[11] Patent Number: 5,222,466

[45] Date of Patent: Jun. 29, 1993

[54] INTERNAL COMBUSTION ENGINE WITH FLEXIBLE/PISTON CYLINDER

[76] Inventor: Itzchak Gratziani, 20 Zalman Shnior Street, Haifa, Israel

[21] Appl. No.: 885,305

[22] Filed: May 18, 1992

[51] Int. Cl.[5] ..... F02F 1/10

[52] U.S. Cl. ..... 123/193.6; 92/249

[58] Field of Search ..... 123/193.6, 193.1, 197.2; 92/90, 89, 137, 172, 248, 249

[56] References Cited

U.S. PATENT DOCUMENTS

| | | | |
|---|---|---|---|
| 4,044,728 | 8/1977 | Moeller | 123/193.1 |
| 4,453,508 | 6/1984 | Groager | 123/193.1 |
| 4,800,858 | 1/1989 | Yang | 123/51 R |
| 4,852,542 | 8/1989 | Kamo et al. | 123/193.6 |
| 4,867,121 | 9/1989 | Bivona et al. | 123/193.6 |

OTHER PUBLICATIONS

C. Van Amerongen, The Ways Things Work (1967), p. 472, Simon & Shuster, N.Y. translated from original German language Edition, copyright Bibliographische Institute A.G. Mannheim (1963).

*Primary Examiner*—David A. Okonsky

*Attorney, Agent, or Firm*—Wolf, Greenfield & Sacks

[57] ABSTRACT

A system for harnassing the combustion of a fuel and an oxidizer includes a base that has valved ports as inlets for the fuel and oxidizer and an outlet for the combustion products. The combustion occurs in a flexible container, preferably a thin walled metal bellows. The container expands in response to the combustion. This expansion is coupled to an output device to perform useful work, preferably hydraulically with a hydraulic fluid held in a rigid housing surrounding the flexible container. The housing, which can include the base, has a valved inlet and outlet for the hydraulic fluid. The system includes an arrangement to contract the container after combustion. Applications of this apparatus include modular hydraulic power generators, a marine propulsion system with water as the hydraulic fluid, an automotive-type engine with a conventional crank shaft, and a Wankel-type rotary engine.

9 Claims, 10 Drawing Sheets

INTERNAL COMBUSTION ENGINE WITH FLEXIBLE/PISTON CYLINDER

BACKGROUND OF THE INVENTION

This invention relates to devices for deriving useful work from the controlled combustion of fuels within the device. More specifically, it relates to an internal combustion system that avoids a rigid piston movable within a rigid cylinder to convert the combustion energy into either a mechanical or hydraulic output.

One of the most widely used sources of mechanical power, particularly portable power sources, is the internal combustion engine. In all of its commercial forms, this engine is characterized by a rigid piston or piston-like member that moves within a rigid cylinder, or a comparable structure. In standard Otto-cycle four stroke engine, a generally cylindrical piston reciprocates within a cylindrical bore (cylinder) in an engine block. A crankshaft converts the reciprocating motion into a rotary output torque. Valves and a spark plug are mounted at one end of the cylinder. The basic approach is the same for diesel engines, except ignition is produced through the compression of a fuel-oxidizer mixture without the use of a sparkplug. In the last century the only radical departure in the design of the internal combustion engine wa the Wankel rotary engine. A rigid rotating piston replaces the reciprocating piston. A rigid surrounding chamber with a generally elliptical shape functions as the cylinders. An output shaft is connected directly to the rotating "piston".

All of these known engines address competing design consideration, and have limitations inherent in the common aspects of their solution to these design problems. Any internal combustion engine produces a significant level of heat of the combustion. Rigid moving parts must be able to resist the heat and to operate over a wide range of temperatures, from a cold start to very high temperatures during normal operation. The engine must have a cooling system that effectively dissipates the heat of combustion before it builds to levels that are destructive of the engine. It is also necessary to seal one rigid part that moves with respect to another rigid part in a high temperature, dirty and generally hostile environment. Wear of the seal is an important factor in the performance and product life of standard Otto-cycle engines, and a major reason why Wankel rotary engines have not supplanted the Otto-cycle engines in powering automobiles. Friction at the seal also reduces efficiency. Lubrication of the moving parts and seals is essential to reduce friction and control wear. Also, the rigid moving parts must closely match in dimension and be manufactured to close tolerances, which is reflected in increased manufacturing costs.

The operation of the engine also requires a mechanical coupling of the movement of the piston to an output shaft and a mechanism for coordinating the movement of the piston with the operation of valves to control the introduction of fuel and an oxidizer to the cylinder and an exhaust of the combustion products. For Otto-cycle and Wankel engines, the coordination includes a firing of a spark plug to initiate the combustion.

The solution of a rigid piston-moving-in a rigid cylinder has certain inherent drawbacks. As noted above, rigid elements moving against one another require special seals, close tolerancing, lubrication over the surfaces in moving contact, and are susceptible to wear. Second, the material used to form conventional rigid pistons and cylinders, usually a form of steel, limit the operating temperature of the engine to a lower range than is desirable for maximum efficiency and the production of the lowest amount of objectionable products of combustion (pollution). Third, in any engine where a piston reciprocates, the mass of the piston is a source of inefficiency since some percentage of the energy produced by the combustion is used to reverse its direction of movement and accelerate the mass of the piston or pistons. The greater the mass, the greater the inherent energy loss within the engine.

Mass is also a factor in containing the internal combustion. An engine block for a cylinder or cylinders must be able to withstand the explosive force and heat of the combustion. Typically, this means forming each cylinder as a bore in a large, heavy block of metal. The weight of the block is a major component in the overall weight of an engine and a major drawback for engines and used to power a vehicles such as automobiles or airplanes. Further, conventional rigid pistons must be mechanically coupled to a power output, typically a rotating crankshaft. To obtain a hydraulic or pneumatic output, the internal combustion engine is typically used to drive a separate piece of equipment such as a compressor.

It is therefore a principal object of this invention to provide an internal combustion system that requires no special seals, exhibits excellent wear resistance, and requires no special lubrication for a member moving in response to the internal combustion.

Another principal object of this invention is to provide an internal combustion system with the foregoing advantages and which is inherently and automatically well cooled.

A further principal object is to provide an internal combustion system that can operate at higher combustion temperatures than are possible with conventional engines to increase the efficiency of the system and reduce the emission of environmentally harmful combustion products.

Still another advantage of the invention is to provide a system that is easily maintained and has a low weight as compared to similarly rated conventional rigid piston engines.

Another advantage of the present invention is that the part or parts responding to the combustion do not have to be machined to close tolerances and can be formed, at least in part, from component materials that exhibit low densities, good wear and heat resistance, and have favorable costs of manufacture.

Yet another advantage of the present invention is that the energy of the fuel combustion can be converted directly into either hydraulic output or a mechanical output.

A still further advantage is that the internal combustion system of the present invention can be readily assembled in modules to tailor the capacity of the engine.

SUMMARY OF THE INVENTION

An internal combustion system features a flexible container that is supported on and secured to a rigid base containing 1) valved ports to introduce fuel and an oxidizer and to exhaust combustion products and 2) an igniter to initiate combustion in a fuel-oxidizer mixture in the flexible container. The flexible container so mounted will sometimes to referred to herein as a flexible piston or flexible piston/cylinder to emphasize the difference between the present invention and the conventional rigid piston and cylinder combination. The valves operate in coordination with the igniter. The flexible piston is preferably a generally cylindrical structure secured with a bellows-like side wall, one closed end, and an open end secured to the base over the ports and igniter, thereby defining a flexible combustion chamber. The flexible piston is formed of a sheet of structural material that is (i) flexible, (ii) capable of withstanding the heat, chemical corrosion and explosive force of the fuel oxidizer combustion, and (iii) exhibits good resistance to material fatigue. A suitable flexible piston can be formed as a thin walled bellows of metal, a ceramic cloth or a composite material of high strength fibers and a ceramic resin. A metallic bellows can have an inner lining of a ceramic or the like which is heat resistant and insulating to retain sufficient heat in the combustion chamber to promote combustion at a more efficient and less polluting temperature than possible with present commercial engines.

In a preferred form the flexible container is surrounded by a liquid such as a hydraulic fluid or oil that in turn is held in a rigid housing. The liquid and the surrounding housing 1) provide mechanical support for the container, 2) transfer the heat of combustion away from the container and 3) couple the movement of the container in response to the combustion to an external circuit to produce work. The liquid can also operate, or be used to control the operation of, the system. The housing preferably includes inlet and outlet ports that connect liquid to a circuit; expansion of the container increase pressure in the liquid to drive it through the outlet port and along the circuit.

The engine includes an arrangement for compressing the flexible container after expansion due to internal combustion. In the preferred form this contraction is affected through the hydraulic circuit. After expansion, the outlet port to the engine is closed, the inlet port opened and a pressurized flow of the liquid to the inlet contracts the container to its initial position, thereby expelling the combustion products from the container through the exhaust port in the base. In other form, the contraction can be provided by (i) a spring (ii) a mechanical coupling to the output shaft driven by inertia or other flexible container engines (iii) tandem flexible pistons where each piston drives an air compressor that in turn contracts the other flexible piston or (iv) a hydraulic circuit with a control valve greater in response to the position of the flexible piston during its cycle of operation to direct hydraulic fluid out of the engine to do work or into the chamber to contract the container in preparation for a successive cycle of operation. Where the flexible piston is not surrounded by a liquid, cooling arrangements can include spraying a cooling fluid into its outer surface.

Applications include coupling the inlets and outlets of like flexible piston hydraulic generators to common manifolds to produce a composite modular generator. The invention is usable as a marine propulsion system where sea water is the hydraulic liquid. It is drawn through a vessel from a forward port to the generator where it enters the space between one or more of the flexible pistons and a rigid housing. Internal combustion in combination with appropriate valving drive the sea water out this space to a conduit leading to an aft discharge port, thus propelling the vessel in a forward direction. In another form a flexible piston engine of the present invention is coupled hydraulically to a conventional piston and crankshaft, thus isolating the heat of combustion from the rigid moving components of a conventional Otto-cycle engine. In yet another form, flexible container engines with associated hydraulic circuits are coupled with a Wankel-type engine to isolate the combustion from the rigid, sliding components and thereby overcome the significant seal and wear problems heretofore inherent in the Wankel engine design.

These and other features are objects of the present invention will become evidence to those skilled in the art from the following detailed description which should be read in light of the accompanying drawings.

DETAILED DESCRIPTION OF THE PREFERRED EMBODIMENTS

Figure 1:
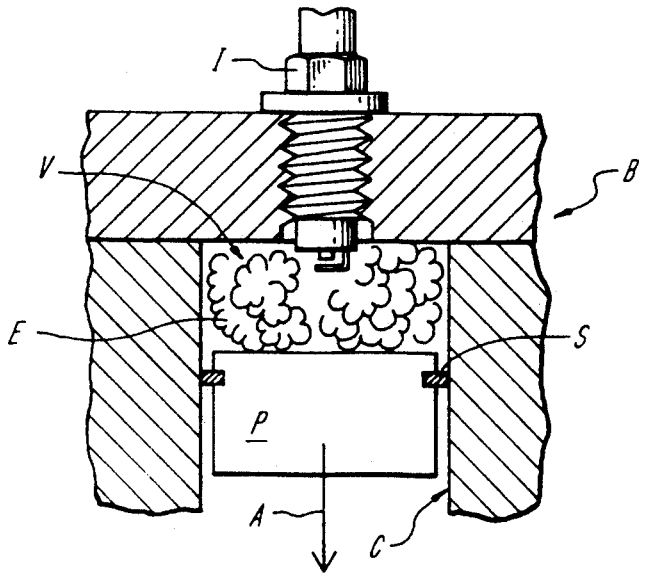
FIG. 1 (PRIOR ART)
FIG. 1 is a simplified view in vertical section of a prior art Otto-cycle rigid piston internal combustion engine with portions of the cylinder broaden away and with valves, ports and a connecting rod omitted for clarity.

FIG. 1 shows a conventional Otto-cycle internal combustion engine with an engine block B, a rigid cylinder bore C, a rigid piston P movable in a reciprocating manner within the cylinder C, a ring seal S carried on the piston P to establish a sliding seal between the piston and the cylinder, and a spark plug I threaded into the block B at the head of the cylinder to ignite and combust a fuel-air mixture in a volume V defined by the closed end of the cylinder above the piston and under the spark plug. The combustion of the fuel-air mixture as shown by E converts the chemical energy of the fuel and an oxidizer into mechanical energy, a linear movement of the piston P along the cylinder C, as indicated by the directional arrow A. The usual valves and piston connecting rod to a crankshaft are not shown. As discussed above in the background, any such rigid piston system must be machined to close tolerances, must use high temperature, wear resistant seals to contain the explosive force of the combustion in the volume V, requires lubrication of the parts that slide against one another, and must have a system to cool the engine, typically a flow of water or air through and/or around the engine block.

Figure 2:
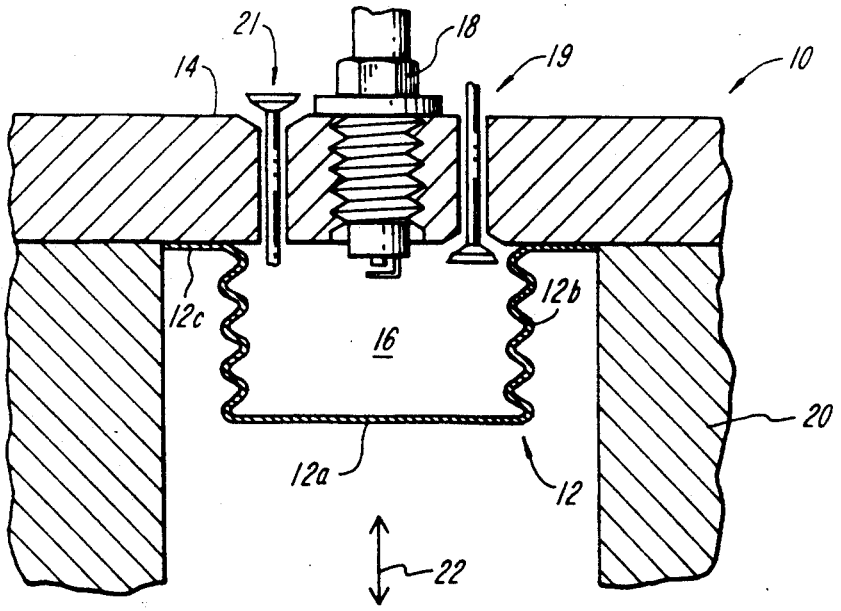
FIG. 2 is a simplified view in vertical section corresponding to FIG. 1 showing a flexible piston internal combustion system according to the present invention.

FIG. 2 shows in a highly simplified form a flexible piston/cylinder engine 10 according to the present invention. The engine features a flexible container 12, shown in its preferred form as a thin-walled metal bellows with one closed end. A rigid base block 14 mounts the bellows 12 at a flange 12 to form an enclosed combustion chamber 16. A spark plug 18 is replaceably secured in the base over the flexible piston to ignite the fuel oxidizer mixture. A valved port 19 introduces a fuel oxidizer mixture to the combustion chamber through the base 14. A similar valved port 21 provides an outlet to exhaust combustion products from the chamber 16. A rigid housing 20 surrounds the bellows 12 in a spaced relation. (The flexible container 12 is also referred to herein as a "flexible piston/cylinder", or simply as a "flexible piston", or as a "bellows" since this term describes its presently preferred form.) The housing 20 extends "vertically", in the direction of the arrow 22, for a sufficient distance that the bellows 12 can expand freely along the direction 22 with its lower end wall 12 moving forwardly and its corrugated side wall **12*b* unfolding, in accordian fashion, in response to the combustion of a fuel oxidizer mixture in the chamber 16**.

Figure 3:
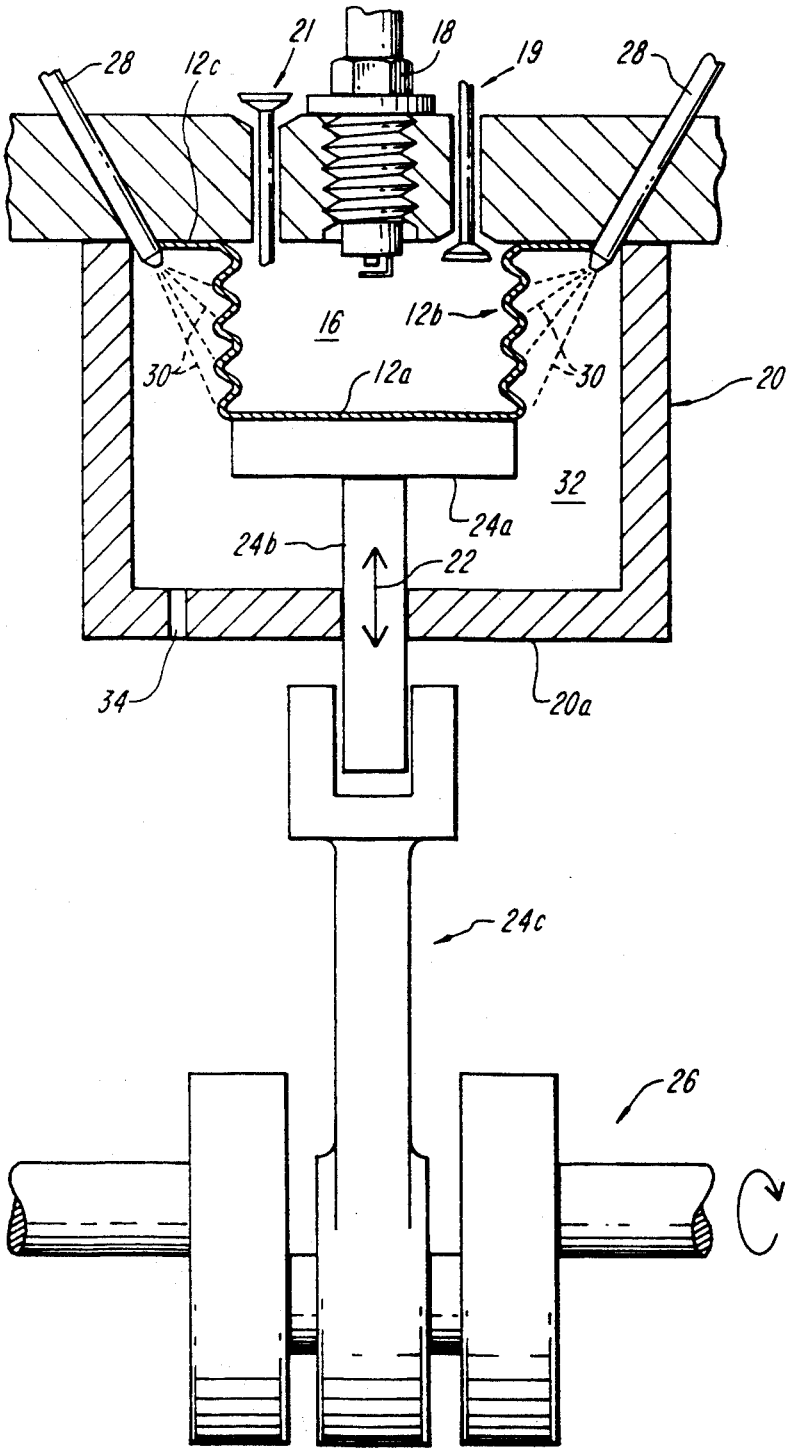
FIG. 3 is a simplified view in vertical section, and partially in side elevation, of a flexible piston system according to the present invention with a mechanical coupling to a crankshaft for compression and spray cooling of the flexible piston to convert combustion into a mechanical energy output.

FIG. 3 illustrates an application of the flexible piston/cylinder 12 used in internal combustion system including the engine 12 and a mechanical coupling 24 that converts the expansion of the flexible piston/cylinder 12 in the direction 22 into mechanical energy, namely, rotation of a conventional crankshaft 26 such as is commonly employed in prior art internal combustion engines. The coupling 24 includes a rigid plate **24*a* that abuts and supports the end wall 12*a*, a rod 24*b* secured to the plate 24*a* at its upper and end freely slidable in an opening in a lower wall 20*a* of the housing 20, and a conventional connecting rod 24*c* that is pivotally connected to the lower end of the rod 24*b* and to an eccentric shaft 26*a* of the crankshaft. The rod 24*b* is shown in direct sliding engagement with the wall 20*a*, but it will be understood that it can reciprocate along the direction 22** in any suitable bearing and/or seal.

In the embodiment shown in FIG. 3, the bellows 12 must have sufficient structural strength to withstand and contain the force of the combustion while not destroying the corrogated configuration of the side wall **12*b***. This generally requires that the walls of the bellows be made thicker than the walls of bellows discussed below with hydraulic exterior support, or made of a material demonstrating an increased tensile strength Both of these solutions have disadvantages in decreasing the efficiency of the engine, increasing its cost, or leading to an unacceptable degree of material fatigue in a relatively short period of time. Note that the corregations combined with the expansion of the bellows contain and absorb the force of the combustion so that the walls can be relatively thin-walled to a degree that would rupture the bellows if there was no expansion.

A principal characteristic of this invention is that the bellows 12 are thin walled and flexible to allow a comparatively unimpeded expansion of the bellows in response to the combustion. The bellows 12 can be formed of any of a variety of metals. Alternatively it can be formed of non-metallic, heat-resistant materials such as ceramic cloth, woven ceramic fibers, or composites formed from high strength fibers or cloth of graphite or the plastic sold under the trade designation Kevlar combined with a ceramic resin. It is also contemplated that a metallic bellows can be coated on its inner surface with a layer of a heat resistant insulating material such as a suitable ceramic.

The bellows 12 is preferably formed from a continuous integral sheet of material to enhance its structural integrity and provide the maximum strength at the lowest weight. The flange **12*c* is also preferably integral. It is secured to the base either permanently, as by welding, brazing, or adhering, or it can be replaceable as by a gasket and bolt combination or any of a wide variety of more complex structures such as a snap on or screw on mounting fixture that is permanently sealed to the flange 12*c* and replaceable secured and sealed to the base 14. A replaceable attachment allows a damaged or worn bellows to be replaced readily. (To facilitate replacement of the flexible piston, the housing 20** can be replaceably secured to the base as by conventional gaskets (similar to head gaskets currently used on automotive engines) and bolts.

The bellows 12, while shown with a substantially uniform thickness, can also be manufactured with a thickness that varies to provide varying degrees of flexibility and strength depending on the principal function and operative conditions of the various parts of the bellows.

As shown in FIG. 3, tubes 28 are secured in the base 14 and have outlets that direct a spray 30 of cooling liquid onto the outer surface of the bellows side wall **12*b*. This arrangement presumes that the space 32 surrounding the bellows in the housing 20 is filled with a gas, typically air. A drain 34 directs the sprayed, heated liquid out of the housing. Valved ports 36 and 38 are inlets for a fuel oxidizer mixture and an exhaust outlet for combustion products (exhaust), respectively. As shown, the valved ports are preferably formed in the base 14**; they can be conventional automotive valves.

Figure 3A:
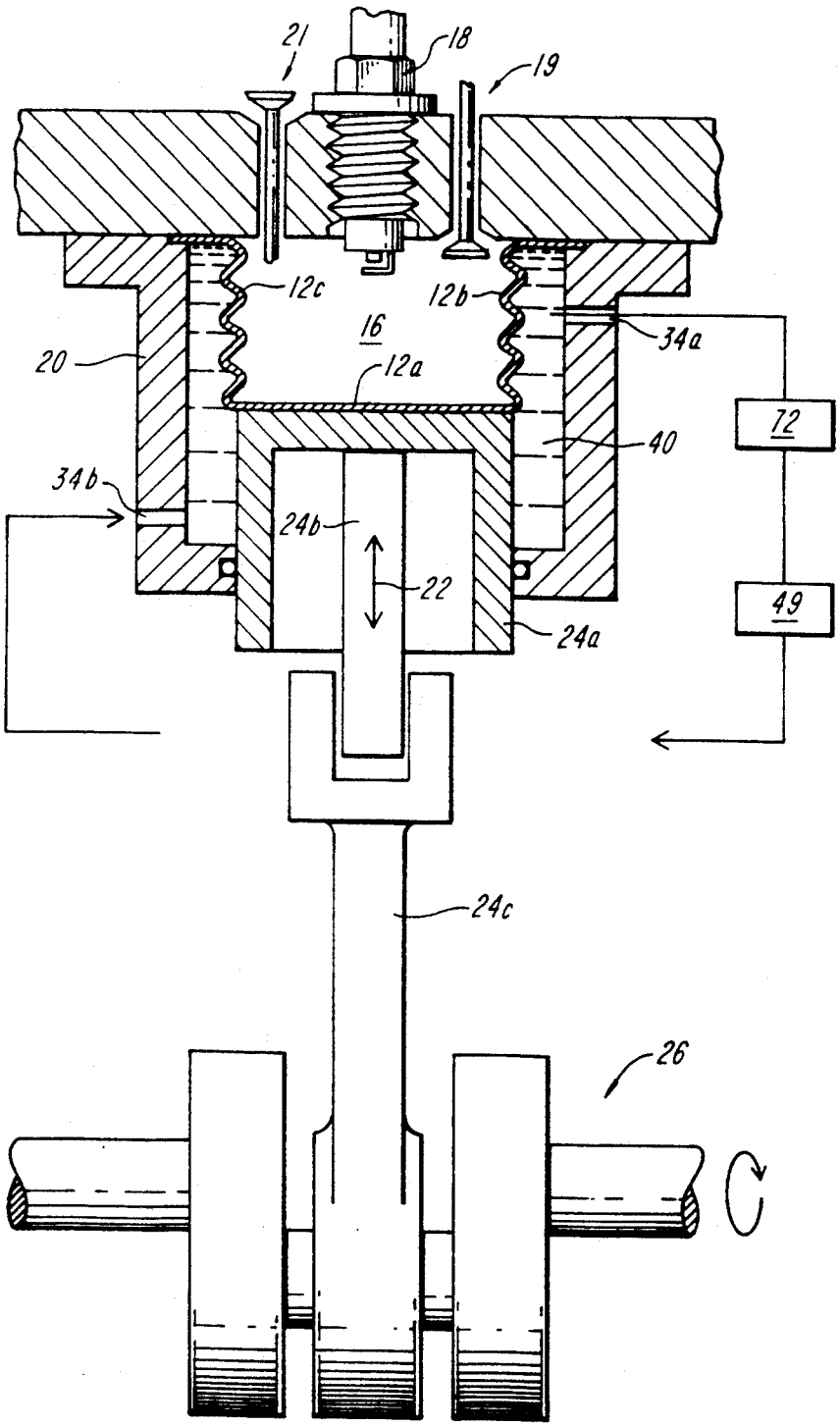
FIG. 3A is a view corresponding to FIG. 3 showing an alternative embodiment.

FIG. 3A illustrates modified arrangement of the flexible piston/cylinder of FIG. 3. In this modification the bellows 12 is surrounded by hydraulic fluid 40 which equalizes the compression and combustion pressures inside the bellows. Thus there is substantially no pressure difference between the inside and outside of the bellows. This enables one to make the bellows from a thin wall material, because the net resultant forces acting on the bellows are very small. The hydraulic fluid 40 also cools the bellows by circulating the fluid 40 through ports **34*a*, 34*b* using an auxiliary pump 72 operated in an appropriate period of the cycle of operation. The hydraulic circuit also includes a load 49 that is powered by the expansion of the bellows transmitted via the hydraulic fluid 40**.

Figure 4:
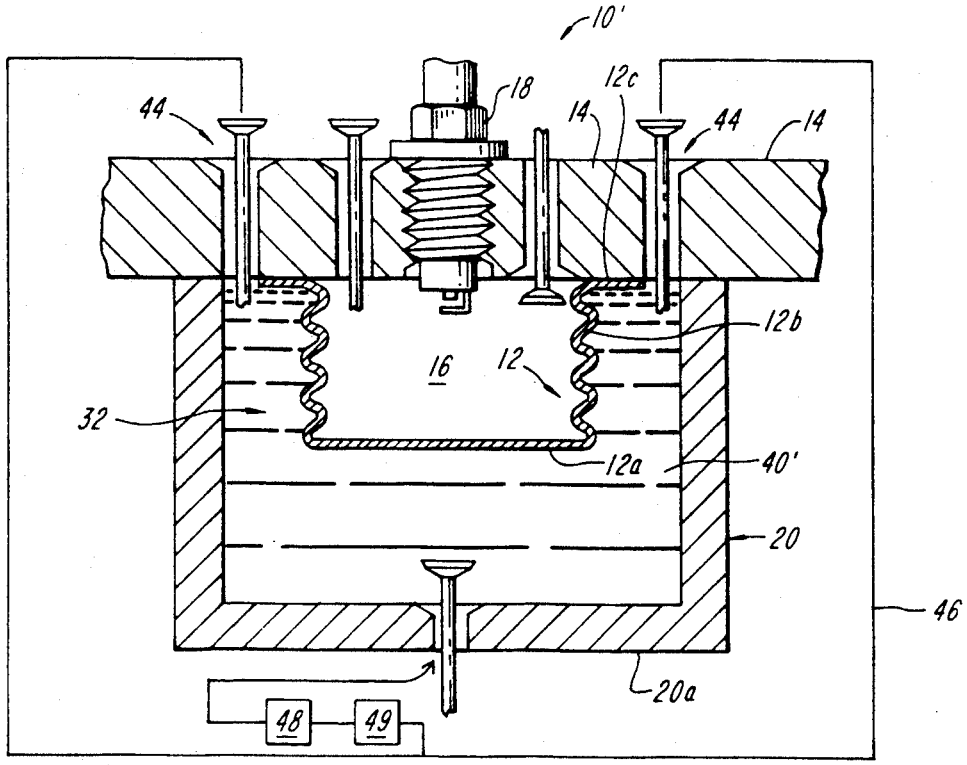
FIG. 4 is a simplified view in vertical section corresponding to FIG. 2 showing a preferred embodiment of the invention with the flexible piston supported and cooled by a surrounding body of hydraulic fluid connected by valved ports to a hydraulic circuit, not shown, to convert combustion directly into a hydraulic energy output.

FIG. 4 illustrates a preferred form of the invention where the space 32 is filled with a hydraulic fluid 40 so that the engine, or more accurately, combustion hydraulic power generator 10', converts the chemical energy of combustion directly into hydraulic power that can perform work in hydraulic motors or cylinders (not shown). (Like parts in each of the illustrated embodiments are identified with the same reference numbers.) This arrangement is preferred over the FIG. 3 embodiment in part because the fluid supports the bellows against the high gas pressures that develop within the bellows during combustion. Since gases and fluids distribute an applied pressure uniformly throughout their volumes, and because the bellows is thin walled and flexible, a high pressure within the bellows is transmitted through the flexible bellows to the surrounding hydraulic fluid. As a result, the pressure difference between the inside and outside of the bellows is near zero at any given moment in the cycle of operation of the generator 10'. This situation allows very large absolute pressures of the combustion gases to exist in the combustion chamber 16 while subjecting the bellows 12 to very low stress. The low stress in turn allows the bellows to be made from a thin and very flexible material which would, in the absence of the surrounding hydraulic fluid 40, burst under the pressure of the combustion gases.

The housing 20 in the FIG. 4 embodiments is rigid, but has no rigid piston moving against it. The housing contains the hydraulic fluid 40 in a chamber 32. The walls of the housing have a sufficient thickness to withstand the hydraulic pressure. Note that there are no critical dimensions and no close tolerances between the housing 20 and the flexible piston/cylinder 12. Also, the housing is isolated by the hydraulic fluid from the combustion chamber and its motion (the expansion of the bellows) that translates the chemical energy of combustion into useful work.

The housing 20 as shown has a valved hydraulic fluid (oil) inlet port 42 and two valved hydraulic fluid outlet ports 44, 44. The valves operate as check valves to allow a flow in one direction only. In the form shown in FIG. 4, the oil outlet ports are actually in the base 14, which can be considered as a part of the housing 20 since it also holds the fluid 40 as well as mount the flexible piston/cylinder 12. These valved outlets allow the hydraulic fluid to flow through a hydraulic circuit 46, shown in a highly simplified schematic form in FIG. 4, from the outlets, 44, 44 and back to the inlet. The circuit can include a heat exchanger 48 after a load 49 such as a hydraulic motor, or use the heat dissipation inherent in the circuit, but in any event the flow of hydraulic fluid through the chamber 32 and the circuit cools the bellows 12. The expansion of the bellows, pumps the oil out of the chamber 32, through the outlets 44, 44 and through the circuit 46. Cooled return oil flows into the chamber 32 through the inlet 42. With the valves arranged as shown, this directs a flow of the cooled fluid upwardly along the outer surface of the bellows 12. The hydraulic fluid and circuit therefore continuously and automatically cool the bellows. In addition, the hydraulic fluid acts to some extent as a heat sink, and to some extent the housing 20 and base 14 are heated and radiate a portion of the thermal energy generated within the bellows 12. The valves or valved ports 19, 21, 42 and 44 can take any of a variety of conventional forms such as cam operated, spring-loaded valves commonly used in automobiles.

Because there is no friction of rigid members moving against one another, and because the very high temperatures are confined to the bellows, composite materials can be used for the housing to reduce weight and lower the cost of manufacture. This heat containment, which also aids combustion efficiency and reduces pollutants in the exhaust, can be enhanced by using the aforementioned heat insulating, heat resistant coatings on the interior surface of the bellows.

Figure 5:
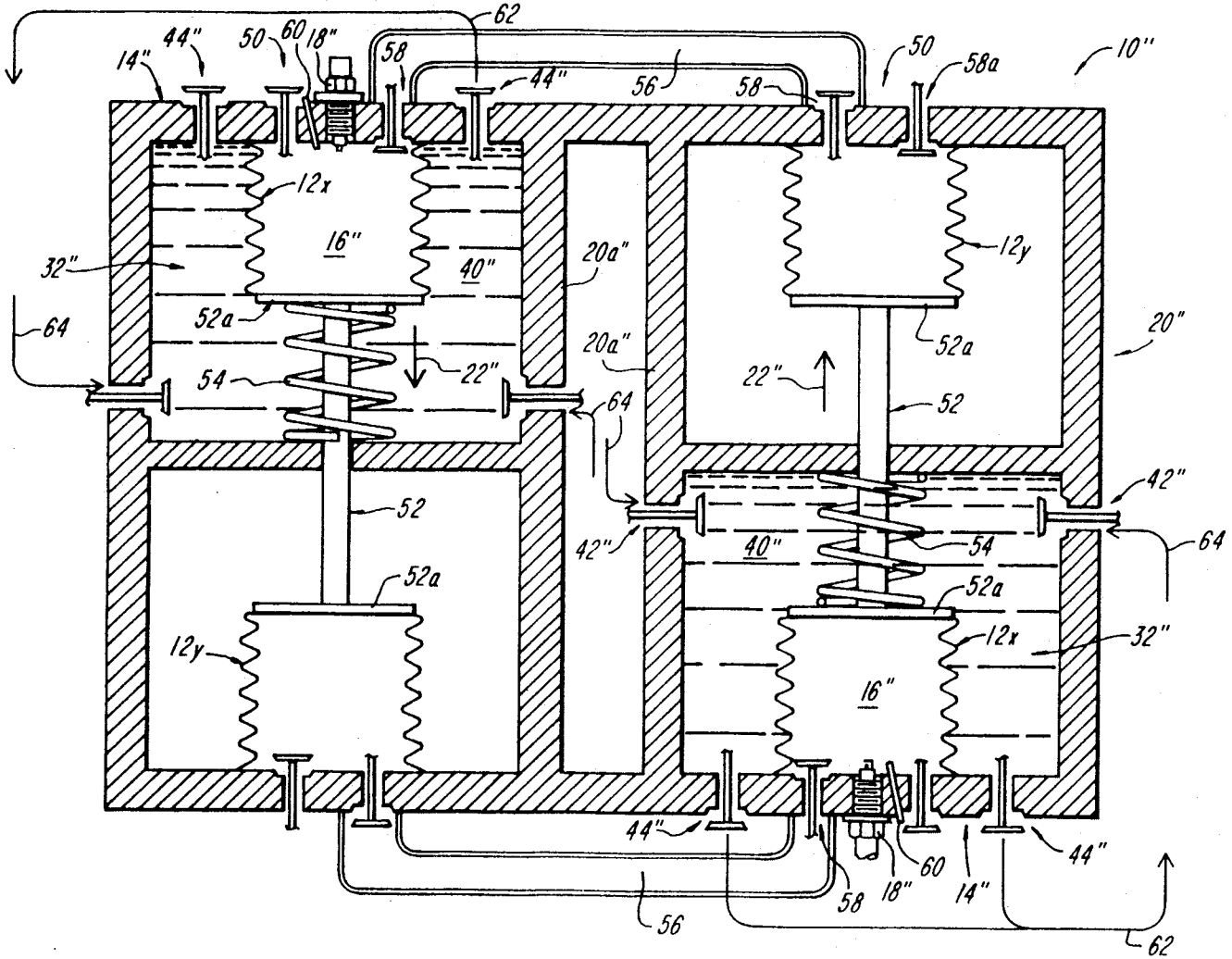
FIG. 5 is a simplified view in vertical section of a hydraulic power generator module according to the present invention powered by a tandem pair of flexible piston engines of the type shown in FIG. 4 with spring and pneumatic air circuits to contract the piston.

FIGS. 5-10 illustrate a variety of systems based on the flexible piston/cylinder described above with reference to FIGS. 2-4. Turning first to FIG. 5, a combustion hydraulic power generator 10'' is shown which utilizes two identical units 50, 50 in a common housing 20'' with a pair of internal dividing walls **20*a*'', 20*a*''. (Again, like parts are identified with the same reference number. The double prime indicates that the flexible piston/cylinder system 10 is incorporated in a different device, here a tandem, two stroke hydraulic power module.) The units 50, 50 are oriented 180° opposite to one another in a head to toe arrangement. Each unit 50 has two flexible piston/cylinders, one an internal combustion bellows 12*x* as described above and the other an air compressor 12*y***. The generator itself can comprise one or a plurality of these modules depending on the power output requirements of a given application. The modules can be coupled linearly, or tangentially in a ring architecture.

Turning to the construction and operation of one such module, combustion expands a bellows **12*x* along the direction 22 as described above with reference to FIGS. 2-4. A connecting rod 52, preferably capped at both ends with a plate 52*a* that matches and supports the end walls 12*a* of the bellows 12*x* and 12*y*, couples the movement of pairs of bellows 12*x* and 12*y* in each unit 50. In the left unit 50 as shown, a spring 54 holds the bellows 12*x* in a contracted position as compressed air is directed by a channel 56 and a valved port 58 into the right hand combustion chamber 16''. A fuel injector 60 injects fuel into the chamber. The spark plug 18'' ignites the fuel-air mixture causing the bellows to expand and pump the hydraulic fluid 40'' in the chamber 32''. The increasing fluid pressure in the chamber 32'' opens outlet valves 44'', 44'' to a high pressure line 62** indicated schematically. (It is also within the scope of the invention to use externally actuated valves, as well as valves that are self biased to close and open in response to a fluid pressure above a set value.)

Expansion of the right hand bellows **12*x* acts through the rod 52 to compress air in the right hand bellow 12*y*, which then flows through the upper channel 56 and valved port 58 to the left hand combustion bellows 12*x*. The spring 54, then begins to drive the right hand bellows 12*x* back toward its original contracted position. In the process it compresses and exhausts combustion products from the bellows 12*x*. At the same time a low pressure hydraulic fluid return line 64 introduces fluid to the chamber 32 via valved inlet ports 42'', 42'' in the side walls of the housing 20'' and 20*a*. The return motion under the force of the spring 54 also draws fresh air into the right hand bellows 12*y* through a valved port 58*a*. At the same time the left hand bellows 12*x* receives injected fuel and combustion is initiated. This begins a repeat of the cycle of operation described above with respect to the right hand unit 50, with expansion of the left hand bellows 12*x* producing a high pressure out-flow of hydraulic fluid from the two left hand valved ports 44'', 44'' while compressing the left hand air bellows 12y. The units 50, 50** thus provide a direct source of hydraulic power with a two stroke cycle of operation at a pair of combustion bellows operating in tandem.

Figure 6:
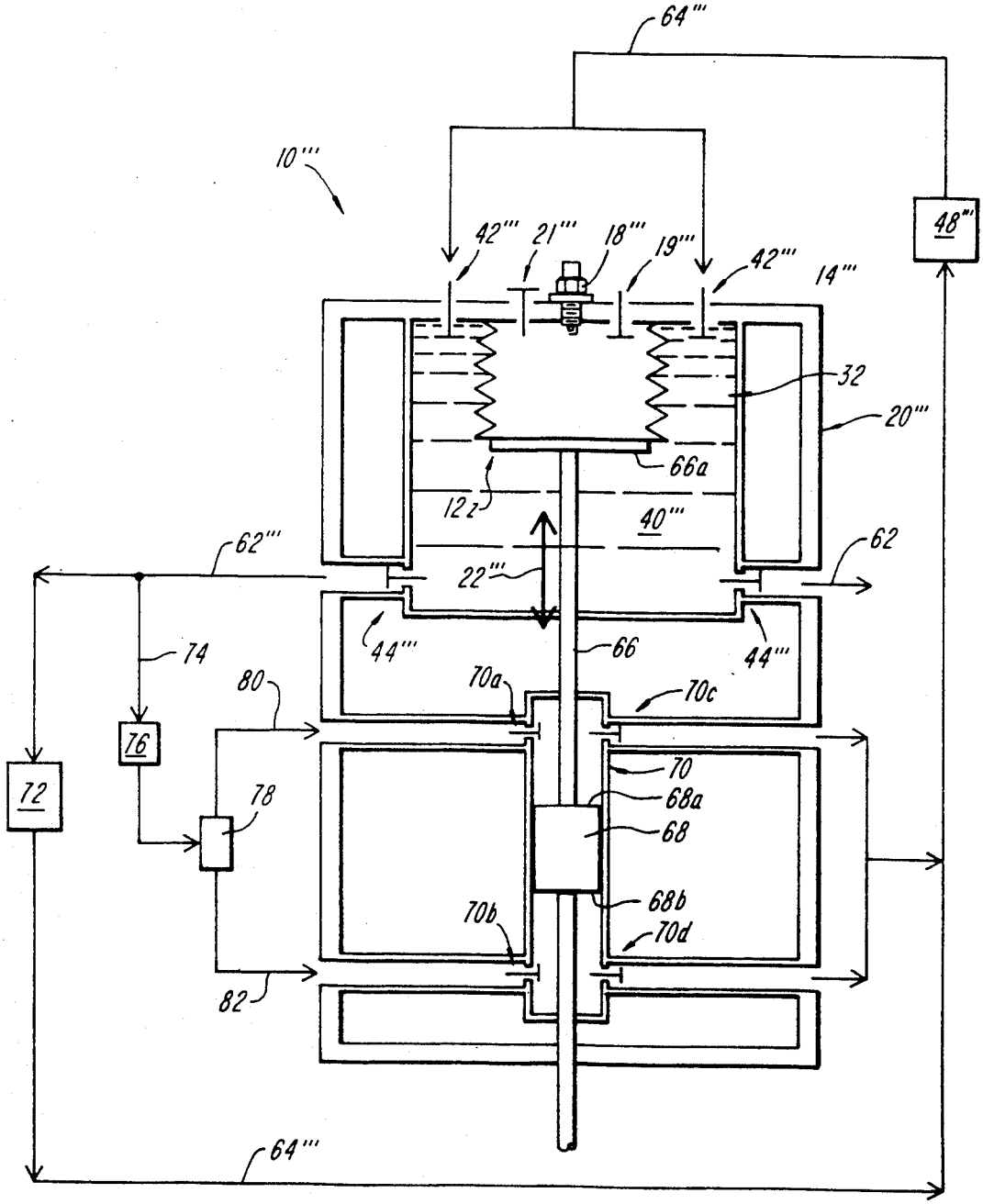
FIG. 6 is a simplified view in vertical section corresponding to FIG. 5 showing a four stroke hydraulic generator according to the present invention utilizing a single flexible piston.

FIG. 6 shows another embodiment of the present invention, a flexible piston/cylinder 12z using internal combustion to power a four stroke hydraulic power generator 10'''. (Again, like parts in the various embodiments are identified with the same reference number.) The end wall 12a''' of the bellows is secured to a control rod 66 through an end plate 66a. The rod 66 carries a small piston 68 slidingly engaged for movement along the direction 22''' in a valve housing 70 mounted below the bellows 12z. The bellows 12z operates in the manner described above with respect to FIG. 4. High pressure hydraulic fluid is pumped by an expansion of the bellows during combustion through high pressure valved outlet ports 44''', 44''' to a high pressure line 62''', a hydraulic load 72 where work is performed, and back to low pressure inlets 42''', 42''' via a low pressure return line 64''' that includes a heat exchanger 48'''.

A portion of the high pressure flow from the line 62''' is diverted via a branch line 74 has a hydraulic pressure accumulator 76. The branch line feeds a control valve 78 that directs the flow either to an output line 80 or 82. Line 80 is connected to a "downward" valved port 70a and line 82 is connected to an "upward" valved port 70b, both ports being inlets to the housing 70. When the control valve 78, acting in response to an electrical, mechanical, hydraulic, pneumatic or any other form of control signal, directs the flow along the output line 80, it flows through the port 70a and past its associated check valve. The pressure of the fluid in the housing 70 above the piston 68 drives this piston downwardly along the direction 22'''. This movement is transmitted by the rod 66 to the bellows 12z which expands in the absence of combustion to suck a fuel air mixture into the bellows 12z intake (stroke 1). The control valve then switches the flow from line 80 to line 82 causing the pressure in the line 82 to act on the lower surface 68b of the piston. This raises the piston to compress the fuel-air mixture in the bellows as the bellows contracts (compression stroke 2). During this compression stroke, fluid over the piston 68 exits the housing 70 by valves exit port 70c connected to the low pressure line. Also, the volume of the chamber 32''' increases thereby lowering the hydraulic fluid pressure around the bellows and allowing fresh, cooled hydraulic fluid to enter the chamber from the inlet ports 42''', 42'''. When the compression is complete, the spark plug 18''' ignites the compressed fuel-air mixture causing combustion. The bellows 12z expands to pump the hydraulic fluid exiting the outlet 44''', 44''' (power stroke 3). After completion of the power stroke, the control valve again reverses the flow in the lines 80 and 82, causing an upward movement of the rod 66 which compresses the bellows to exhaust the combustion products (exhaust stroke 4). This completes one cycle of operation. Note that the valves in ports 70a–70d operate in coordination. When there is a flow into one inlet 70a or 70b, the opposite outlet 70d or 70c respectively are open, and the adjacent outlet valves 70c and 70d. respectively are closed.

Figure 7:
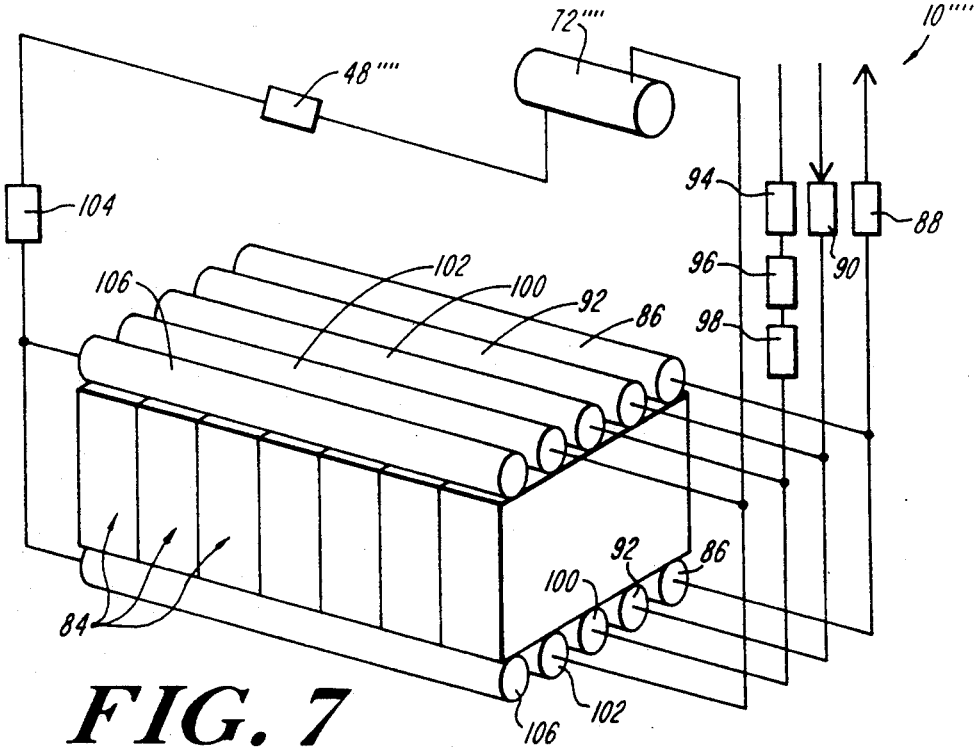
FIG. 7 is a highly simplified view in perspective of a modular hydraulic power generating system.

FIG. 7 shows a hydraulic power generating system 10'''' formed as a stack of modules 84 each of which is a hydraulic power generator of the general type shown in FIGS. 5 or 6. The modules are arranged so that their exhausts exit through a pair of manifolds 86, 86 to a muffler 88 and then to atmosphere. Air is taken from the atmosphere through a air filter 90 and directed to a air manifolds 92, 92 which each extend across the stack of modules are positioned to feed filtered fresh air to the combustion chamber of the flexible piston/cylinders of each of the modules. Fuel is held in a tank 94 and fed through a fuel pump 96 and a fuel filter 98. Fuel manifolds 100, 100 feed the fuel inlet ports 19''' (FIG. 6) in the base of the housing, or to fuel injectors 60 (FIG. 5).

Combustion and the attendant expansion of the piston/cylinders produces a high pressure liquid flow which exits the hydraulic generator through manifolds 102, 102 and is directed by suitable conduits to a load 72 such as a hydraulic motor or piston. A low pressure return line from the load directs the hydraulic fluid through a radiator or heat exchanger 48''' and a filter 104 before returning it to a pair of fluid inlet manifolds 106, 106 in which feed hydraulic fluid to the chambers around the flexible piston cylinders within the housings of each of the modules.

Figure 8:
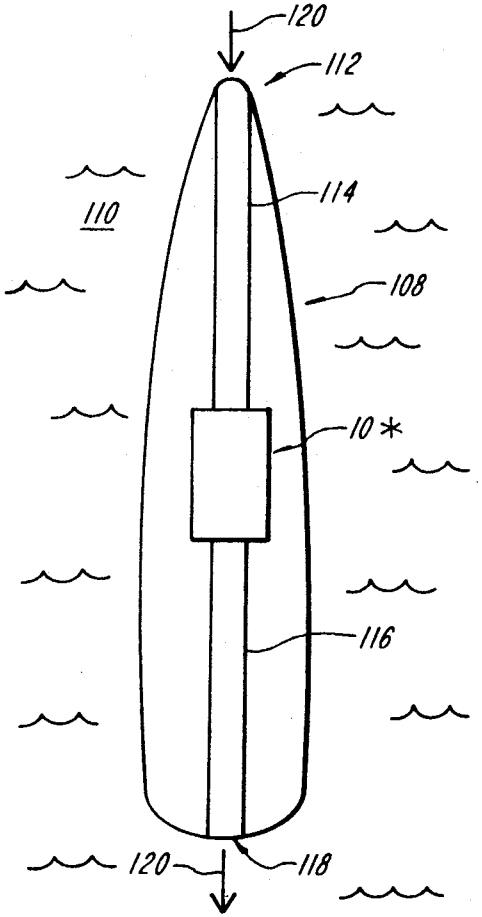
FIG. 8 is a highly simplified top plan view of a marine vessel with a propulsion system utilizing a hydraulic generator according to the present invention.

FIG. 8 illustrates a simplified form for a marine vessel 108 powered by a hydraulic propulsion system 10* utilizing the flexible piston/cylinder invention of the general type described here with respect to FIGS. 2–4 and described in more detail as used in hydraulic generators. In this application, the hydraulic fluid is sea water 110. The sea water 110, flows through a intake port 112 at the bow of the vessel to a combustion hydraulic power generator 10* such as the generator 10'', 10''' or 10''''. A conduit 114 feeds sea water from the port 112 to the low pressure intake manifold or valved inlet ports, of the generator, depending on whether one power module or multiple power module are utilized. The high pressure hydraulic fluid produced by the generator is directed by a conduit 116 to an exit port 118 and the stern of the vessel. The flow of sea wall through the propulsion system is indicated generally by the directional arrows 120. The motion of the vessel in the sea water is in the opposite direction.

Figure 9:
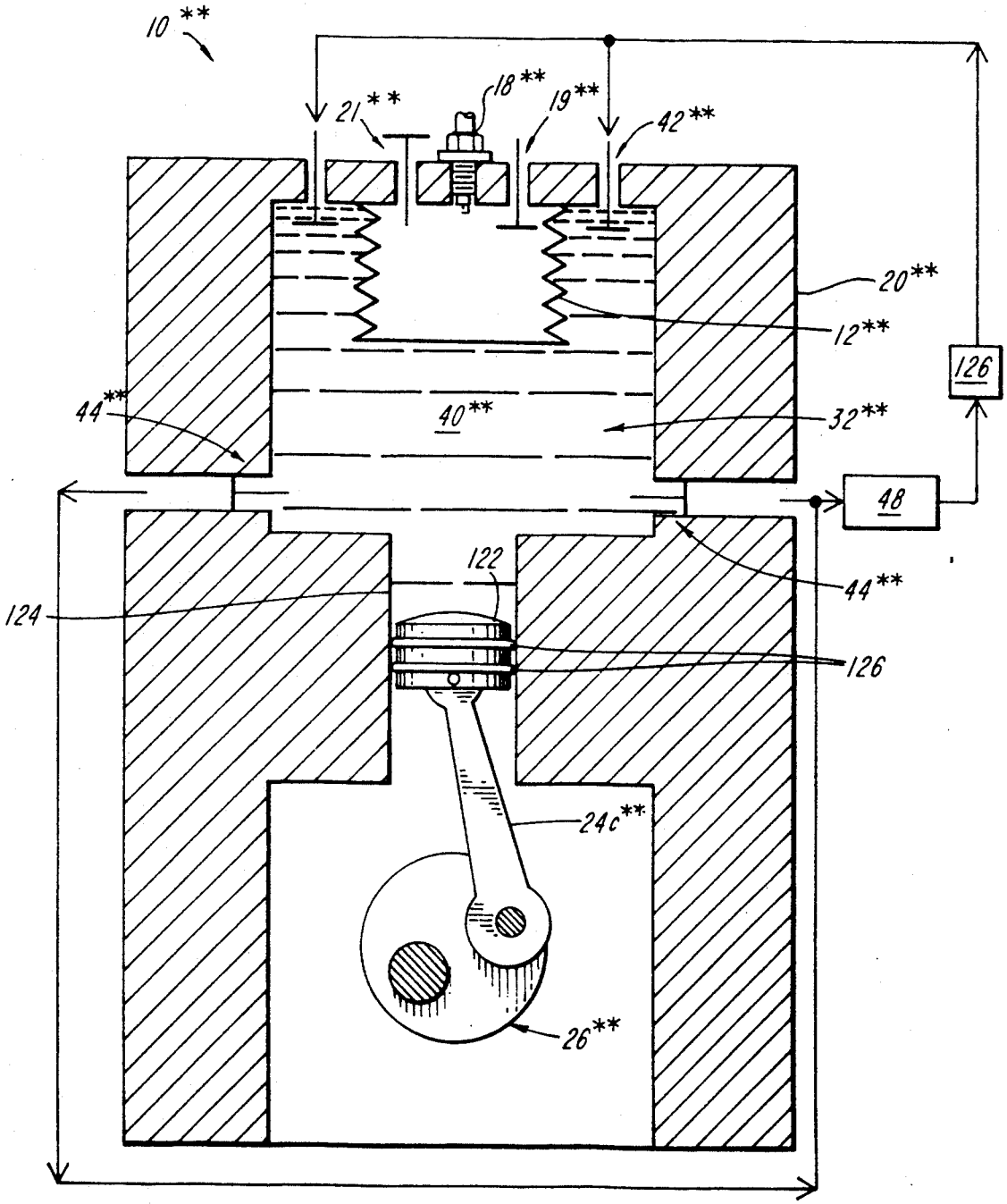
FIG. 9 is a simplified view in vertical section corresponding generally to FIGS. 2–4 showing a four stroke automotive combustion engine powered by a flexible piston (with hydraulic piston contraction) according to the present invention; and FIGS. **10*a*–10*e* are simplified views according to the present invention in vertical section of a rotary combustion engine powered by flexible piston/cylinder according to the present invention of the general type shown in FIG. 4** and in a succession of positions illustrating the four strokes in one cycle of operation.

FIG. 9 illustrates a further application of the present invention. A flexible piston/cylinder 12 of the general type shown in FIG. 4 is coupled with a conventional piston and crank shaft. The piston, however, is isolated from the combustion and has a much lower mass than a conventional piston for an internal combustion engine. This combination yields a four stroke automotive-type combustion engine 10****.

The operation of this engine will be described with respect to its four stroke in the cycle of operation. On a first intake stroke, rotation of the crank shaft 26 causes the piston 122 to move downwardly (valves 21**, 42**, 44** are closed, valve 19** open) which decreases the oil pressure in the chamber 32** causing the bellows 12** to expand downwardly. This expansion draws a mixture of fuel in air into the bellows through fuel-oxidizer inlet valve 19**. A continued rotation of the crank shaft drives the piston 122 upwardly to compress the oil in the chamber 32** and compress the bellows and the fuel air mixture held within the bellows (valves 19**, 21**, 42**, 44** are closed), the compression stroke. When the compression has reached its maximum level, associated with the extreme upward position of the piston 122 in its reciprocating movement within surrounding cylinder 124, the fuel air mixture is ignited by the spark plug 18** and combustion occurs. The combustion expands the bellows 12** which increases the pressure in the hydraulic fluid and drives the piston 122 downwardly (valves 19, 21, 42, 44 are closed) and through the connecting rod 24crotates the crank shaft 26. This is the power stroke. Finally, continued rotation of the crank shaft operating through the connecting rod drives the piston 22** upwardly (valve 19* closed, valves 21, 42, 44 open) a second time which increases the oil pressure in the chamber 32. This pressure increase compresses the bellows 12 to exhaust the combustion products through the exhaust port 21. This movement of the piston and the associated increase in oil pressure also pumps the heated oil through the output valve through a heat exchanger 48 and an auxiliary pump 126 before returning to the low pressure oil hydraulic fluid inlets 42, 42**.

A principal advantage of the engine shown in FIG. 9 is that the heat of combustion is isolated from the conventional mutually sliding engine components which move with respect to one another particularly a rigid piston 122 moving within a rigid cylinder 124. The piston can be comparingly lightweight and both the piston and cylinder ca be made out of less expensive materials and to less rigorous tolerances. The piston 122 carries a pair of ring seals 126, 126 to provide a sliding seal between the piston and the surrounding cylinder 124 to contain the hydraulic fluid within the chamber 32. Despite the motion of the piston 122 within the cylinder, because the piston and seal are not exposed to the heat, thermal cycling and chemical corrosion experienced by conventional pistons with ring seals in direct contact with combustion, the seals 126, 126 can be made of materials less costly, can be manufactured to less strict tolerances, and can operate with a longer life than conventional seals. In addition, the hydraulic oil provides an automatic lubrication for the seals.

FIGS. 10*a*–10*e* show still another embodiment of the present invention, a rotary or Wankel-type internal combustion engine 10− utilizing a pair of flexible piston/cylinders 12L, 12R of the general type shown in FIG. 4. A rotary piston 128 rotates clockwise as shown in a cylinder 130 formed in an engine block 20+. The piston is of the same general type as currently used in Wankel engines. It has a generally triangular configuration with outwardly convex curved side surfaces A, B, and C which act together with the surrounding chamber 130 formed in the housing 20+. The chamber walls facing the sides A, B and C are generally oval shaped and slightly constricted at the middle (epitrochoid) as is conventional for Wankel engine housings. The piston and chamber 130 rotating set of internal chambers 32L, 32R that have varying volumes depending on the angular position of the rotary piston. The rotation produces a four stroke cycle of operation which is described below.

As shown, the housing 20+ mounts a pair of opposed flexible piston/cylinders 12L, 12R ("L" is for "left" and "R" is for "right", as shown) of the type shown in FIG. 4. They are diametrically opposed and directed generally radially. Each rotary piston cylinder is surrounded by a supply of oil 40+ and includes a pair of intake valves for the oil 42L,42L or 42R,42R and a pair of diametrically opposed oil outlet valves 44L,44L or 44R,44R set at the end of radially directed, diametrically opposed ports 44*a*,44*a*. Each valved port 44L,44L,44R,44R feeds the high pressure oil to an associated hydraulic circuit 46+ including a heat exchanger 48+ and auxiliary pump 72+. Each flexible piston/cylinder 12L,12R has an inlet valve 19+ for a fuel mixture and an exhaust valve 21+ for combustion products. The auxiliary pump 72 is ideally not required, particularly for this Wankel embodiment 10−, but it may be necessary in circulate the oil for heat transfer to compensate for pressure drops in pipes, valves and ducts. In certain applications the pressure in the oil circulation system produced by an auxiliary pump, or by the expansion of a flexible piston, may also be used to contract the bellows following an expansion of the bellows during a combustion stroke.

In operation, the rotary piston 128 rotates clockwise in the cylinder 130 as demonstrated by comparing FIGS. 10*a*–10*e* which show successive positions of the surfaces A-C of the rotary piston 128 and the flexible piston/cylinders 12L,12R during one cycle of operation that includes four strokes.

STROKE I (SUCTION)

Figure 10A:
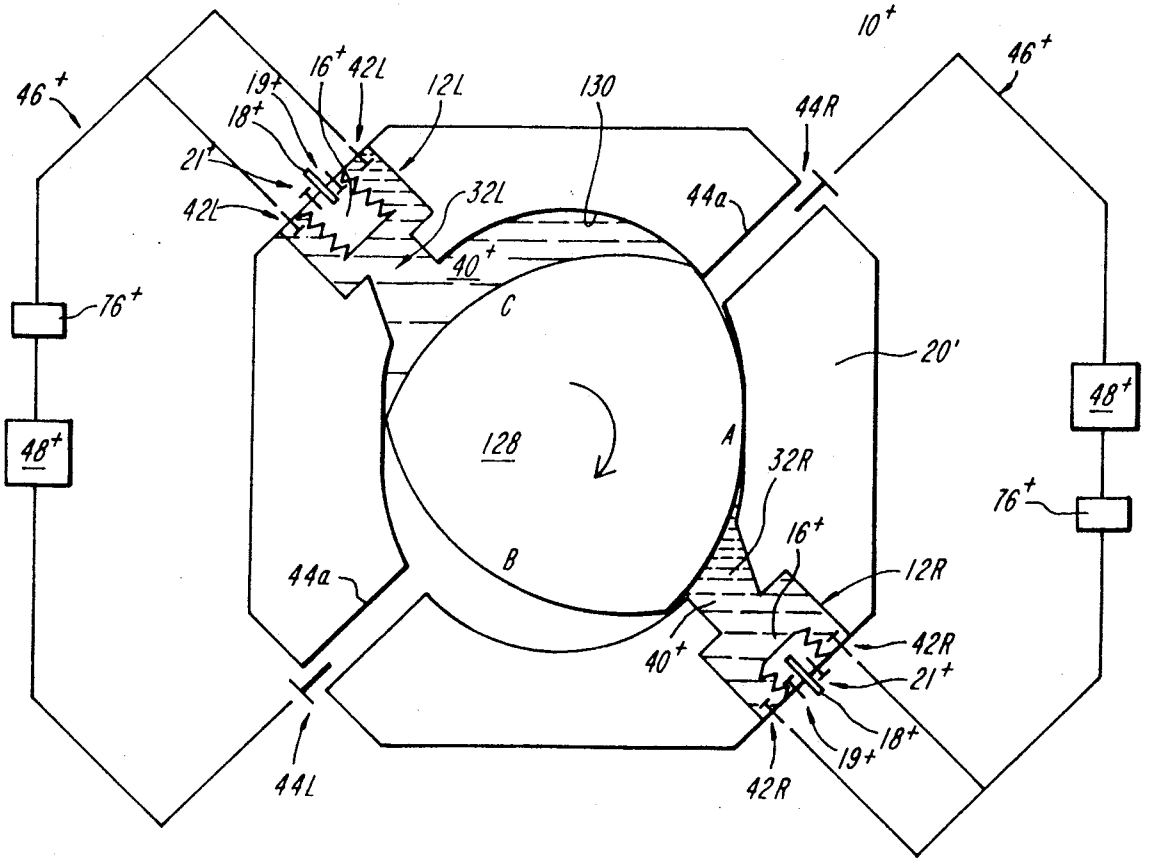

The stroke starts with the piston in the position shown in FIG. 10*a*. When the piston 128 starts to rotate in the clockwise direction as shown, the volume defined by surface A of the piston and the cylinder 130 increases relative to the position of the piston. As valves 42R,42R in the right chamber 32R close, the volume of the oil in the chamber remains constant. Therefore as the chamber volume increases, the oil pressure decreases to around zero. In the bellows 12R valve 19− is open to draw a fuel/air mixture into the bellows since it is at a pressure of about one atmosphere. The pressure difference between the inside of the bellows and the oil pressure in the chamber inflates the bellows until it takes up all the added volume created by the rotation of the piston during this phase of the cycle of operation. At the end of this suction stroke in the right bellows, the piston is in the position shown in FIG. 10*b*.

At the same time the volume defined by surface B of the piston and the cylinder 130 decreases as the piston rotates in the clockwise direction from the position shown in FIG. 10*a*. The oil in this volume is pushed through valves 44L,44L through a heat exchanger 48 and an auxiliary pump 72 to the left chamber 32L. The pump 72 also assists in producing this flow. This addition of oil to the left chamber 32L increases the pressure in this chamber, causing the bellows to contract. This contraction exhausts combustion gases.

At the same time the volume defined by surface C of the piston and the cylinder remains generally constant. The only change is the position of the volume, moving from the left upper side of the cylinder 130 to the right upper side, as shown in FIGS. 10*a* and 10*b*.

STROKE II (COMPRESSION)

Figure 10B:
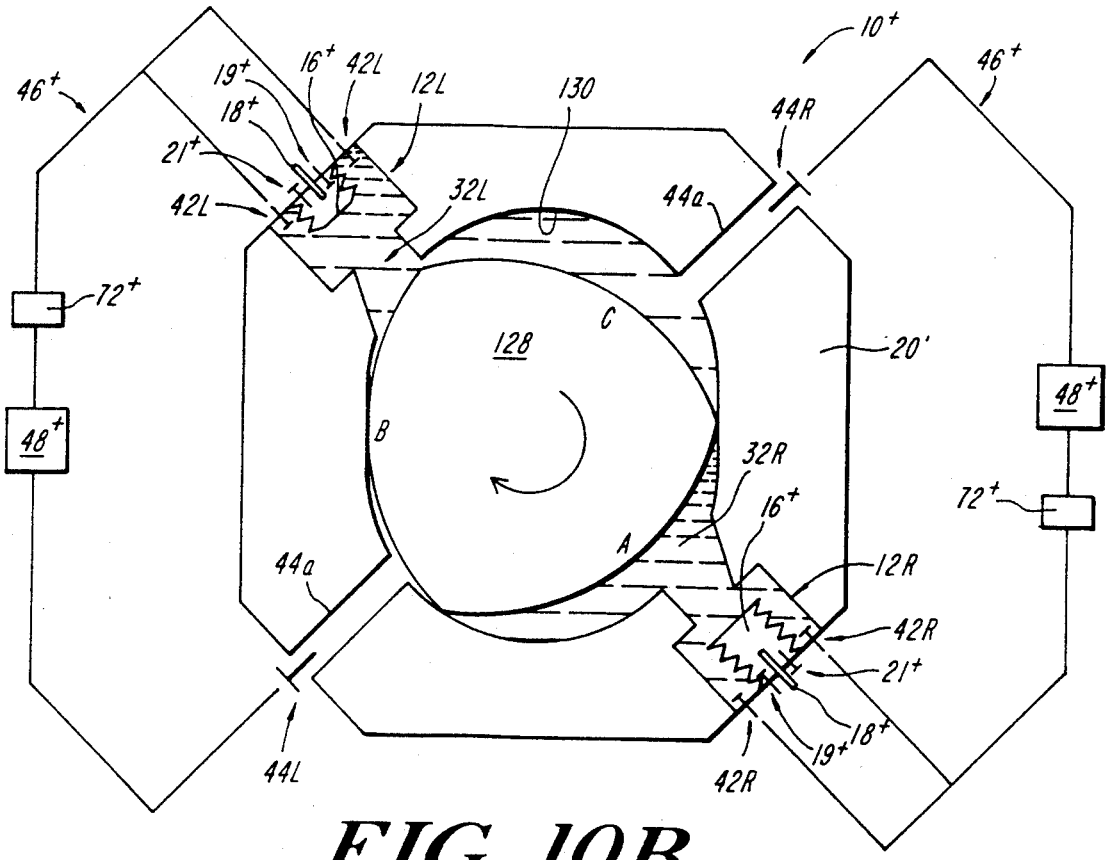

The stroke starts with the piston in the position shown in FIG. 10*b*. The volume defined by surface C of the piston and the cylinder decreases as the piston rotates farther in the clockwise direction. This pushes the oil through valves 44R,44R to the heat exchanger 48 and the auxiliary pump 72 to the right chamber 32R. The added volume of oil in the right chamber 32R increases the oil pressure in this chamber which compresses the bellows and the fuel/air mixture in it (valves 19+,21+ being closed).

Figure 10C:
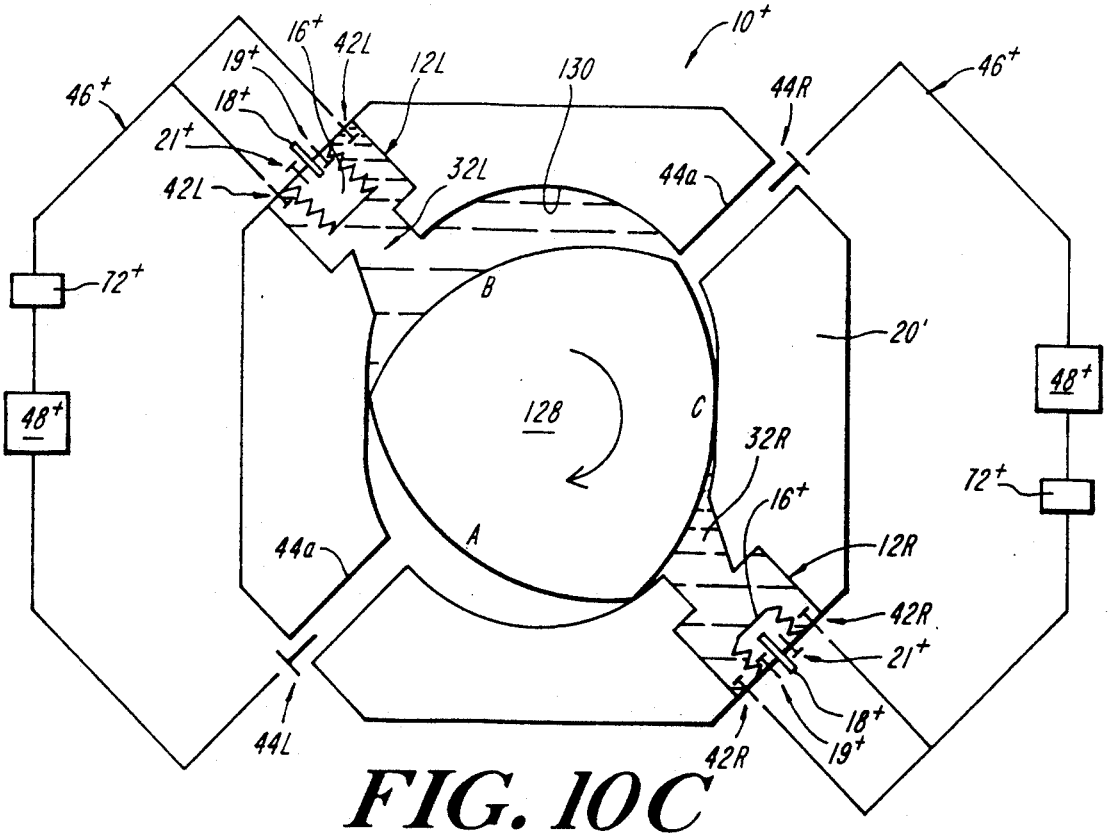

At the same time, the volume defined by surface B of the piston and the cylinder increases as the piston rotates in the clockwise direction. This causes the oil pressure in the left chamber 32L to drop and in the same way as during the suction stroke of the right bellows 12R in Stroke I. The left bellows 12L fills with a fuel- /air mixture. FIG. 10*c* shows the left bellows 12L at the end of its suction stroke.

At the same time the volume defined by the surface A of the piston and the cylinder, remains generally constant, only changing in position from the lower right side of the cylinder (FIG. 10*b*), to the lower left side (FIG. 10*c*).

STROKE III (POWER)

At the start of this stroke the position of the piston is as shown in FIG. 10*c*. The spark plug 18+, ignites the compressed fuel/air mixture in the right bellows 12R. Combustion occurs. The combustion pressure expands the bellows and increases the pressure of the oil 40+ in the right chamber 32R. The oil exerts a force on surface C of the piston which causes the piston to rotate in the clockwise direction. At the end of this power stroke of the right bellow 12R, the position of the piston is as shown in FIG. 10*d*.

At the same time the volume defined by surface A of the piston and the cylinder 130 decreases as the piston rotates in the clockwise direction and thereby pumps the oil through the valves 44L,44L through the heat exchanger 48 and the auxiliary pump 72 to the left chamber 32L. This increased oil pressure in chamber 32L is comparable to the compression stroke in the right bellows; it compresses the left bellows 12L and the fuel/air mixture inside it. At the end of this compression stroke in the left bellow, the position of the piston is as show in FIG. 10*d*.

Figure 10D:
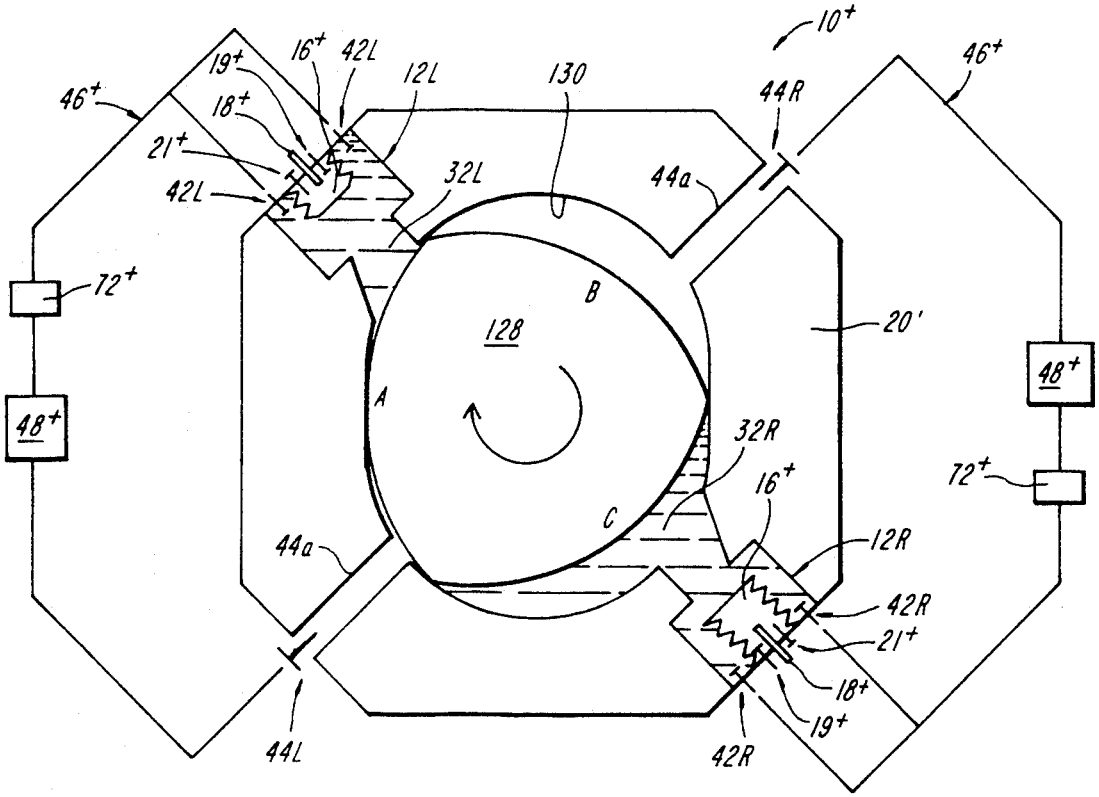

At the same time, the volume defined by surface B of the piston and the cylinder remains constant, changing only its position from the upper left side of the cylinder (FIG. 10*c*) to the upper right side of the cylinder (FIG. 10*d*).

STROKE IV (EXHAUST)

At the start of this stroke the position of the piston is shown in FIG. 10*d*. The volume defined by surface B of the piston and the cylinder decreases. The oil in this volume is pumped through valves 44R,44R to the right chamber 32R via the heat exchanger 48 and the auxiliary pump 72. This added volume of oil in the right chamber 32R compresses the right bellows 12R. This exhausts combustion gases through the valve 21+.

At the same time, the spark plug 18− in the left bellows 12L ignites the compressed fuel/air mixture. Combustion occurs in the left bellows. This combustion expands the left bellows 12L, and, as in the right bellows 12R in the previous stroke, the oil exerts force on surface A of the piston and rotates it in the clockwise direction. At the end of this left power stroke the position of the piston is as shown in FIG. 10*e*.

Figure 10E:
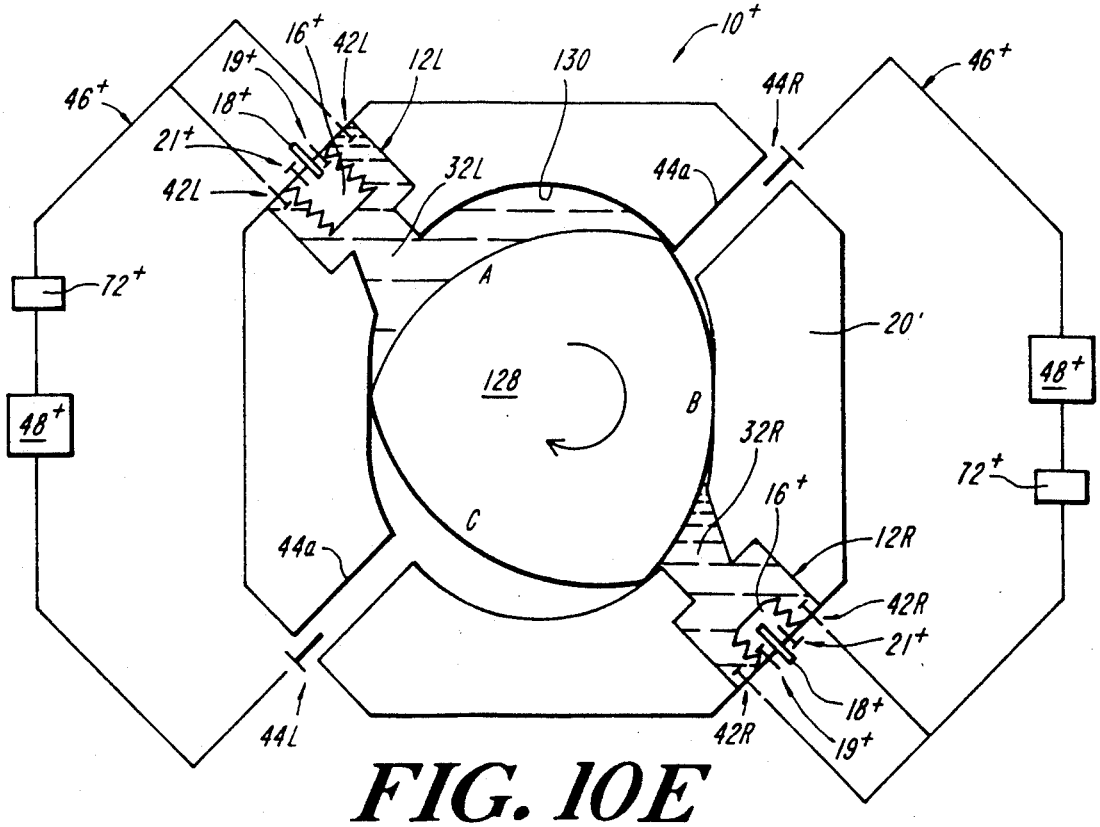

At the same time the volume defined by surface C of the piston and the cylinder remains constant; only the position of the volume changes from the lower right side of the cylinder (FIG. 10*d*) to the lower left side (FIG. 10*e*).

As been described in internal combustion power system which avoids all of the major drawbacks to internal combustion engines such as special seals, wear, lubrication of rigid moving parts, cooling, close tolerance machining, weight, and the inherent energy losses in accelerating and decelerating with each stroke a heavy metallic piston reciprocating in a bore. The present invention provides either a mechanical or hydraulic output without the use of a separate compressor. It requires no special seals, shows excellent wear resistance, and requires no special lubrication for the member that moves in response to the internal combustion. The invention also is inherently and automatically well cooled and is readily able to operate at higher temperatures that ar compatible with the materials that form a conventional internal combustion engines. The engine can be formed of composite materials having a favorable cost as compared to the metallic constructions known in the past and can be machined with less rigid tolerances since the moving parts of the system are isolated from the heat of combustion.

While this invention has been described with respect to its preferred embodiments, it will be understood that various modifications and alterations will occur to those skilled in the art from the foregoing detailed description and the accompanying drawings. For example, while the flexible piston/cylinder has been described principally as a bellows shaped member with one closed end and one open end, it is understood that it can have two open ends with a rigid member sealing one end of the bellows and the other end secured to a rigid base or housing. Also, while the invention has been described with respect to a generally cylindrical bellows with corrogated walls, the piston cylinder can take any of a variety of geometric configurations and can accommodate the expansion and contraction in any variety of ways as long as the basic design criteria set forth in this application are met. For example, the bellows can be a generally balloon-like container provided that the material forming the flexible piston cylinder is sufficiently flexible to contract and expand sufficiently to operate in the manner described above. Also, while the motion of the bellows has been described principally as a linear expansion along a direction 22, it will be understood that the expanding motion can occur in a lateral direction, or in substantially all directions in which the flexible piston cylinder is not constrained, particularly where it is operated in the hydraulic mode of the type shown in FIG. 4. For example, the corrogations can be ribs which extend vertically along the side walls to allow a laterally outward bulging cylinder in response to combustion, or have a more complexly shaped corrugations to allow both a lateral expansion in a direction transverse to the arrow 22 and simultaneously a expansion along the direction 22. Still further, while the invention has been described principally with respect to a integral, flexible and thin walled one piece flexible piston, it is contemplated that with suitable constraints and seals it would be possible to form the flexible piston cylinder from multiple segments. We also understood that the various applications shown herein are merely illustrative. An extremely wide variety of applications and modifications will occur to those skilled in the art. All of these various modifications and alterations are intended to fall within the scope of the appended claims.

What is claimed is:

1. An internal combustion system comprising a rigid base means, a flexible container mounted on said base means in a fluid-tight relationship and formed as a thin-walled bellows that expands and contracts along a first direction, means for introducing fuel and an oxidizer into said flexible container, means for exhausting combustion products from said container, means for igniting the fuel and oxidizer to produce a combustion within said container, means for closing said introducing means and said exhausting means during said combustion and open said exhausting means after said combustion, said flexible container, said base means, and said closing means defining a closed combustion chamber whereby combustion within the interior of said chamber causes said flexible container to expand, means for coupling said expansion of said flexible container to a hydraulic or mechanical power output, said coupling means including a rigid housing that together with said base surrounds said flexible container and a supply of a hydraulic fluid between said flexible container and said housing, and means for contracting said flexible container after said combustion.

2. The system of claim 1 further comprising a hydraulic circuit connected to said housing including at least one inlet port and at least one outlet port for said fluid forming in said housing and valve means that allow a flow of said fluid out of said space during said expansion and a flow of said fluid into said volume during said contraction.

3. The system of claim 1 further comprising means for cooling said flexible container.

4. The system of claim 3 wherein said cooling comprises a spray of a liquid coolant directed over the exterior surface of said container.

5. The system of claim 3 wherein said cooling means includes a layer of thermally insulating material bonded to the interior of said flexible container a heat exchanger, located exterior to said housing and means for circulating said hydraulic fluid through said heat exchanger.

6. The system of claim 2 further comprising a pair of said flexible containers operating in tandem, an air compressor associated with each flexible container and operatively coupled to it, whereby the expansion of each of said flexible containers produces a supply of compressed air, means for directing the supply of compressed air from one of said air compressors to an air inlet port formed in said base means and in fluid communication with the other one of said flexible containers, and resilient means driving each of said flexible containers toward a contracted position.

7. The system of claim 2 for operation in a four cycle mode further comprising a piston external to said flexible container and operatively connected to said flexible container, said piston being moveable along said first direction, and said hydraulic circuit operatively connected to said piston to drive it in a reciprocating motion along said first direction to expand and contract said flexible container.

8. The system of claim 1 comprising at least two of said flexible containers and further comprising inlet and outlet manifolds each connected to all of said fuel and oxidizer introducing means and to said exhaust directing means to provide a hydraulic power module.

9. The system of claim 1 for operation in a four cycle mode where said coupling means further comprises a crankshaft, and at least one piston and cylinder combination external to said flexible container and operatively connected to said crankshaft and to said hydraulic circuit to convert a flow of hydraulic fluid during the expansion of said flexible container into a rotary mechanical motion of said crankshaft, and wherein continued rotation of said crankshaft acting through said hydraulic fluid contracts said flexible container.

* * * * *